US008056381B2

(12) United States Patent
Cheng et al.

(10) Patent No.: US 8,056,381 B2
(45) Date of Patent: Nov. 15, 2011

(54) DEVICE FOR PRODUCING PATTERNS

(75) Inventors: Tung-Chen Cheng, Kaohsiung (TW); Yu-Yi Chu, Kaohsiung (TW); Rong-Shean Lee, Kaohsiung (TW); Tzyy-Ker Sue, Kaohsiung (TW); Chun-Chieh Wang, Kaohsiung (TW)

(73) Assignee: Metal Industries Research & Development Centre, Kaohsiung (TW)

( * ) Notice: Subject to any disclaimer, the term of this patent is extended or adjusted under 35 U.S.C. 154(b) by 424 days.

(21) Appl. No.: 12/345,728

(22) Filed: Dec. 30, 2008

(65) Prior Publication Data

US 2010/0147043 A1 Jun. 17, 2010

(30) Foreign Application Priority Data

Dec. 12, 2008 (TW) ..... 97148574 A

(51) Int. Cl.
*B21D 26/14* (2006.01)
*B21J 5/04* (2006.01)

(52) U.S. Cl. ..... 72/56; 72/57; 72/60; 29/419.1

(58) Field of Classification Search ..... 72/54, 56, 72/57, 60, 63; 29/419.1
See application file for complete search history.

(56) References Cited

U.S. PATENT DOCUMENTS

| | | | | |
|---|---|---|---|---|
| 6,938,449 | B2 * | 9/2005 | Kusunoki et al. | 72/57 |
| 7,069,756 | B2 * | 7/2006 | Daehn | 72/56 |
| 7,076,981 | B2 | 7/2006 | Bradley et al. | |
| 7,389,664 | B1 * | 6/2008 | Cheng et al. | 72/56 |
| 2007/0084261 | A1 * | 4/2007 | Golovashchenko | 72/56 |

FOREIGN PATENT DOCUMENTS

CN 1814374 A 8/2006

* cited by examiner

*Primary Examiner* — David Jones
(74) *Attorney, Agent, or Firm* — Alan Kamrath; Kamrath & Associates PA

(57) ABSTRACT

A device for producing a pattern onto a work piece includes a die, an electromagnetic actuator and a base. The die includes a patterned surface, and the patterned surface includes a pattern. The electromagnetic actuator includes an plate body, a convex part and a strip unit connected to the plate body. The electromagnetic actuator is disposed in the base. When the electromagnetic actuator is activated while a work piece is being positioned between the patterned surface and the electromagnetic actuator, an inductive current is generated on the work piece by the electromagnetic actuator, and then a repulsive force is generated between the electromagnetic actuator and the work piece. The repulsive force causes the work piece to adhere to the patterned surface, forcing the work piece to deform against the patterned surface and to take on the shape of the pattern.

17 Claims, 6 Drawing Sheets

DEVICE FOR PRODUCING PATTERNS

BACKGROUND OF THE INVENTION

1. Field of the Invention

The present invention relates to a device for producing a pattern. In particular, the present invention relates to a device which employs an electromagnetic forming process for shaping a work piece.

2. Description of the Related Art

U.S. Pat. No. 7,076,981 discloses a method of forming a bipolar plate through an electromagnetic formation process. The coil in the patent can generate only a single directional magnetic field. Therefore, it is not a suitable method for forming patterns on the sidewalls of a three dimensional metal shell.

Most fine patterns on the metallic surfaces of cell phones are formed through laser engraving, etching or heat transfer printing. A plastic injection manufacturing process is used when a pattern is required to be formed directly onto the casing (as in Taiwan Pat. No. 00544077). However, the pattern produced through this method is of a plastic material and has a low texture quality.

Taiwan Pat. No. 00589929 discloses a manufacturing process and a structure of a metal casing comprising color patterns. The color patterns are first completed on an overlay-film, and the overlay-film is then sintered with the surface of a metal plate through heating. The metal plate is then applied to a metal casing by a pressing process. This is an intricate manufacturing process, and residual stress may be produced during the pressing process.

Taiwan Pat. No. M323183 discloses the casing of a laptop computer made with ceramic metal. The casing of the computer is divided into a bottom metallic layer, a pattern section and a coating layer. These three units are integrated to form a laptop computer casing which can prevent scratch marks as well as corrosion, and which can also be easily cleaned. However, this method diminishes the texture and the sheen of the metallic areas.

Therefore, an improved device and a method thereof for producing a pattern are desired to overcome the above-mentioned shortcomings.

SUMMARY OF THE INVENTION

One object of the present invention is to provide a pattern-producing device for producing a pattern efficiently.

Another object of the present invention is to provide a pattern-producing device having a simple configuration.

A third object of the present invention is to provide a pattern-producing device for producing a fine pattern.

In order to achieve the above-mentioned objects, the present invention provides a pattern-producing device. The pattern-producing device comprises a die and an electromagnetic actuator. The die comprises a patterned surface with a pattern formed thereon. When the electromagnetic actuator is supplied with a current pulse while a work piece is disposed between the patterned surface and the electromagnetic actuator, a repulsive force is generated between the electromagnetic actuator and the work piece. The repulsive force then causes the work piece to impact on the patterned surface, forcing the work piece to deform against the patterned surface and take on the pattern.

The electromagnetic actuator comprises a plate body, a convex part and a strip unit connected to the plate body. The convex part corresponds to a concave part of the work piece when the work piece is disposed between the patterned surface and the electromagnetic actuator.

DETAILED DESCRIPTION OF THE PREFERRED EMBODIMENTS

The advantages and innovative features of the invention will become more apparent from the following preferred embodiments.

Figure 1:
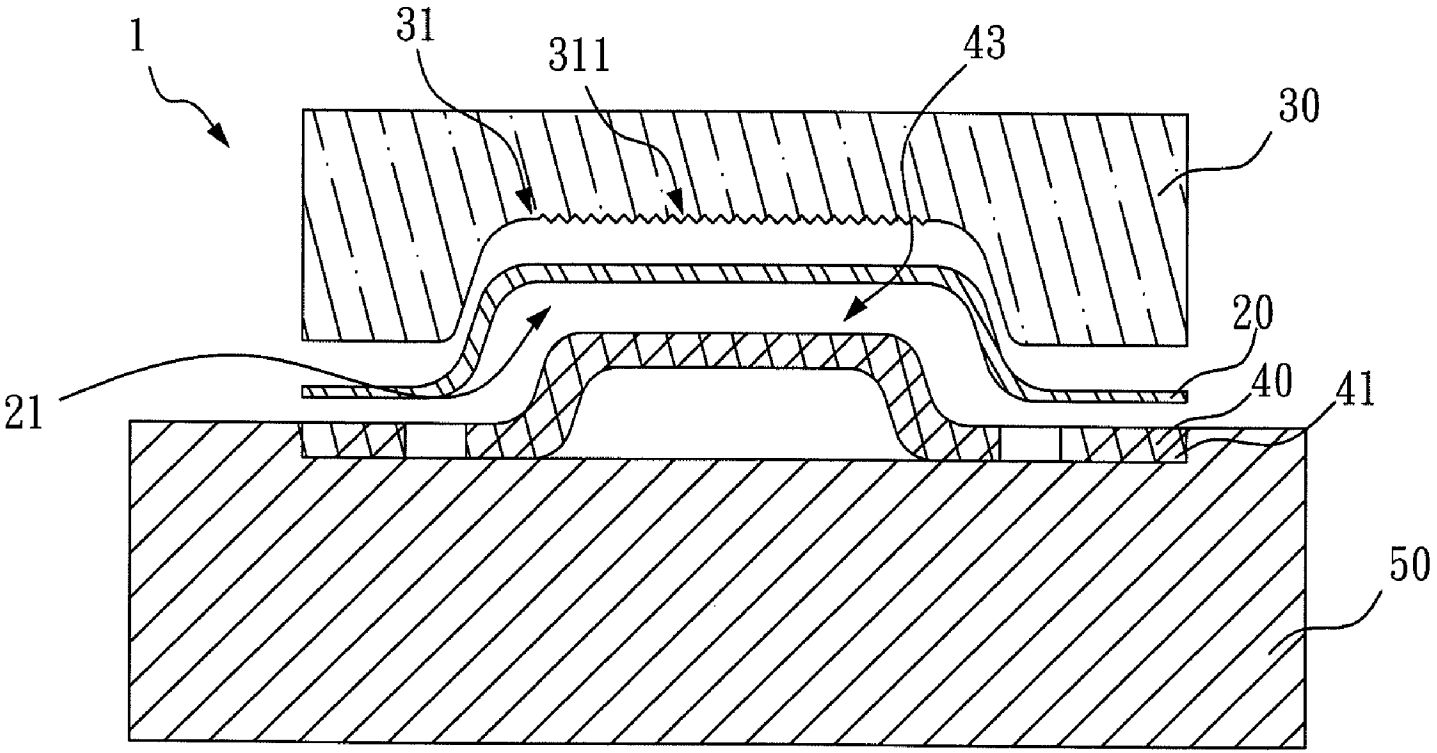
FIG. 1 shows a pattern-producing device of the present invention.
Figure 2:
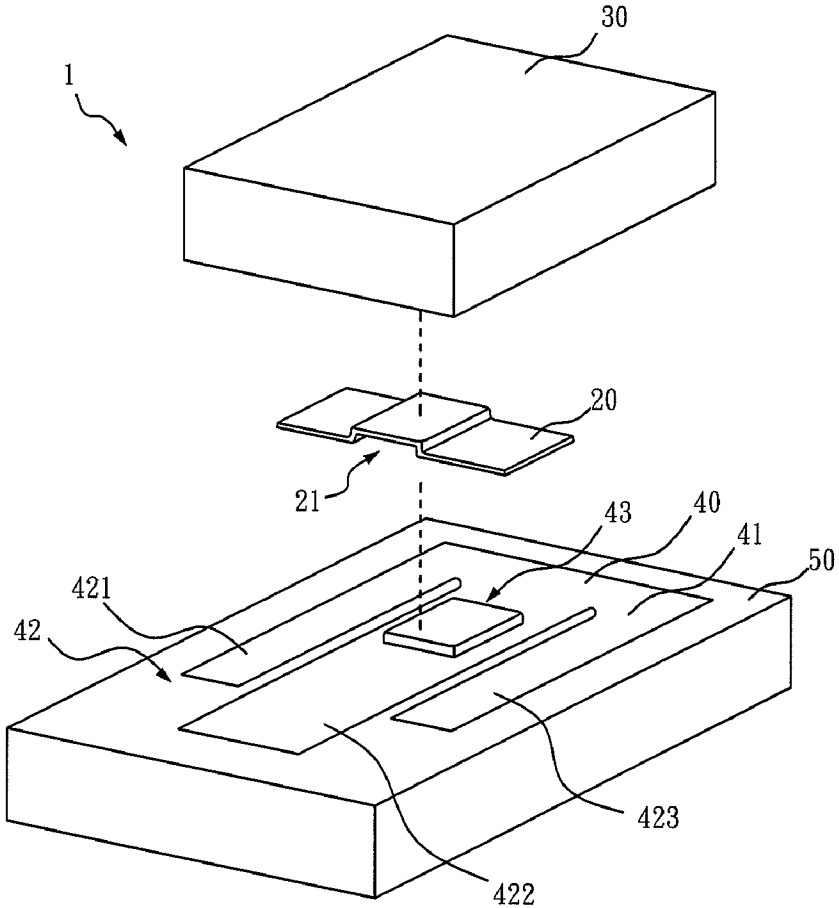
FIG. 2 is an assembly diagram of the pattern-producing device of the present invention.

As shown in FIG. 1, the pattern-producing device 1 comprises a die 30, an electromagnetic actuator 40 and a base 50. The die 30 comprises a patterned surface 31 with a pattern 311 formed thereon. The pattern 311 can be any profile, and a dimension of the pattern 311 ranges between 0.5 μm and 10 mm, but the present invention is not limited only to this specification. The electromagnetic actuator 40 comprises a plate body 41, a strip unit 42 connected to the plate body 41, and a convex part 43 (as shown in FIG. 2, which will be described in more detail). The electromagnetic actuator 40 is disposed on the base 50.

When the electromagnetic actuator 40 is supplied with a current pulse while a work piece 20 is disposed between the patterned surface 31 of the die 30 and the electromagnetic actuator 40, a magnetic field is generated by the electromagnetic actuator 40. The magnetic field induces an eddy current in the work piece 20 and then produces a field repelling against the initial field. A repulsive force is generated between the electromagnetic actuator 40 and the work piece 20. The repulsive force then causes the work piece 20 to impact to the patterned surface 31, forcing the work piece 20 to deform permanently against the patterned surface 31 and to take on the pattern 311.

As shown in FIG. 1, the work piece 20 comprises a concave part 21. The work piece 20 is, but is not limited to, a shell or a casing of a consumer electronics device. The convex part 43 of the electromagnetic actuator 40 corresponds to the concave part 2l of the work piece 20, while the work piece 20 is disposed between the patterned surface 31 of the die 30 and the electromagnetic actuator 40. As a result, holding units of related prior arts which are used for holding work pieces can be omitted, thus simplifying the design of the pattern-producing device. In one embodiment, the work piece 20 can impact the die 30 at a speed exceeding 300 m/sec, replicating a pattern within 10μ seconds to 100μ seconds. However, the present invention is not restricted to these specifications. The repulsive force is a non-contact force, so the work piece 20 receives an evenly distributed force and impacts to the patterned surface 31 instantaneously. This quasi-hydrostatic shaping force is able to minimize the residual stress of the work piece 20. The pattern replicated on the work piece 20 is formed at a high velocity by a non-contacting force. Therefore, it has characteristics, such as high malleability and fewer spring-back quantities, and prevents creases from forming.

In one embodiment, the work piece 20 is made of a metal or any compound material that has a magnetic conducting property. However, the present invention is not limited only to these materials. Any materials, which can induce eddy currents when the electromagnetic actuator 40 is supplied with a current, thus generating a repulsive electromagnetic force between the work piece 20 and the electromagnetic actuator 40, are said to fall within the scope of the present invention. For example, the material of the work piece 20 is selected from aluminum, copper, ferrum, aurum, silver, titanium or any alloy combination thereof. In one embodiment, the base 50 is made of an industrial plastic or a fiberglass resin. Again, the present invention is not limited only to these materials. Any insulant can be used as a material for the base 50.

In the embodiment shown in FIG. 2, the plate body 41 has a shape of a plate. The strip unit 42 comprises three strips including a first strip 421, a second strip 422, and a third strip 423. These strips are all connected to the plate body 41. The convex part 43 is located on top of the second strip 422. Therefore, the electromagnetic actuator 40 is an E-shaped plate. In the present embodiment, the first strip 421, the second strip 422 and the third strip 423 are electrically connected to a power source (not shown).

Figure 3:
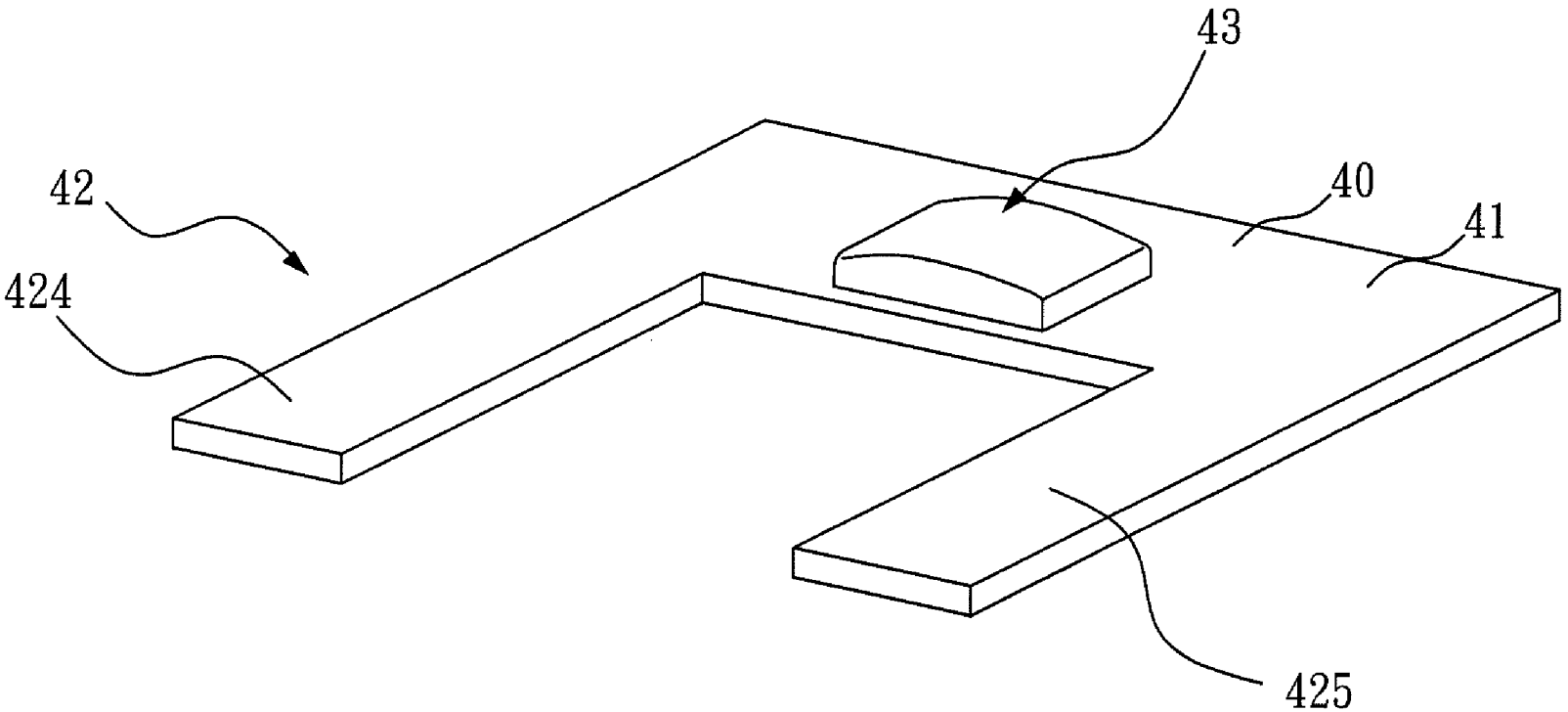
FIG. 3 shows an electromagnetic actuator of the pattern-producing device of the present invention.

In one embodiment, the strip unit 42 of the electromagnetic actuator 40 can comprise two strips, a fourth strip 424 and a fifth strip 425, so to accommodate the formation needs of the work piece 20. The fourth strip 424 and the fifth strip 425 are connected to the plate body 41. Therefore, the electromagnetic actuator 40 is a U-shaped plate (as shown in FIG. 3). The convex part 43 is located on top of the plate body 41. The fourth strip 424, the fifth strip 425 and the plate body 41 are electrically connected to a power source (not shown).

Figure 4:
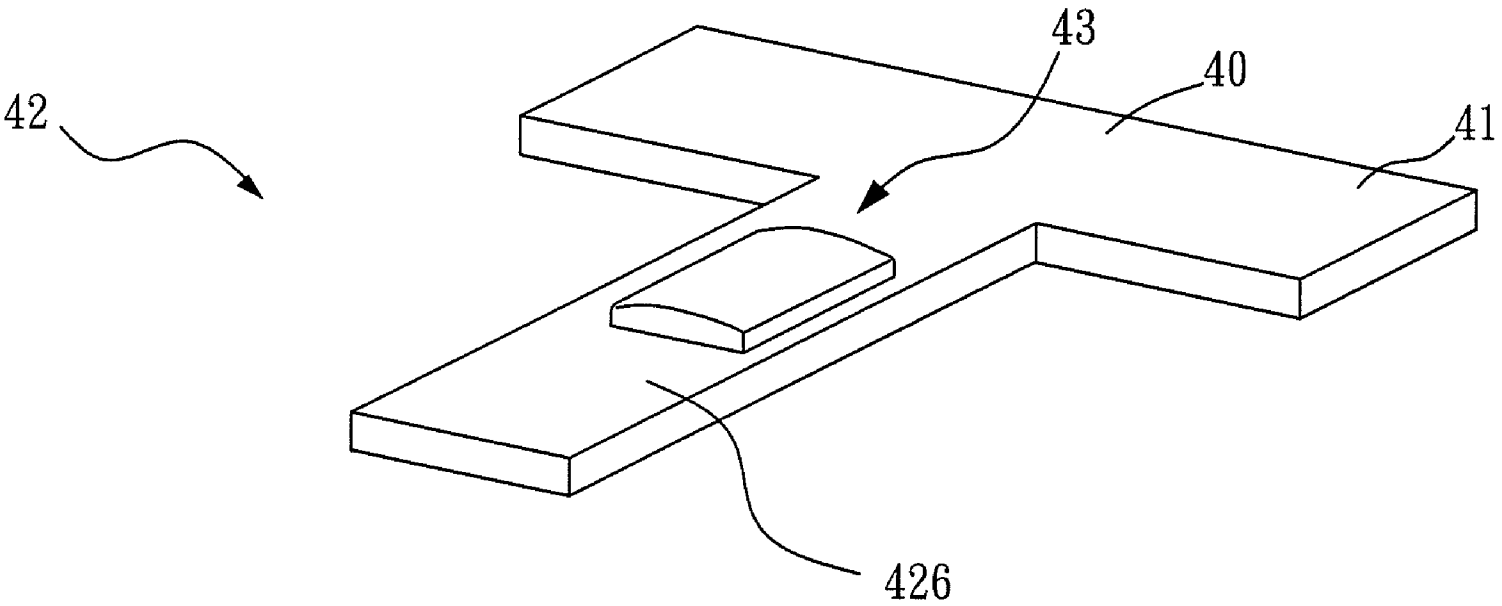
FIG. 4 shows another electromagnetic actuator of the pattern-producing device of the present invention.

In one embodiment, the strip unit 42 comprises a single strip, a sixth strip 426. The sixth strip 426 is connected to the plate body 41. Therefore, the electromagnetic actuator 40 is a T-shaped plate (as shown in FIG. 4). The convex part 43 can be located either on top of the strip unit 42(the sixth strip 426) or on top of the plate body 41. The sixth strip 426 and the plate body 41 are electrically connected to a power source (not shown).

Figure 5:
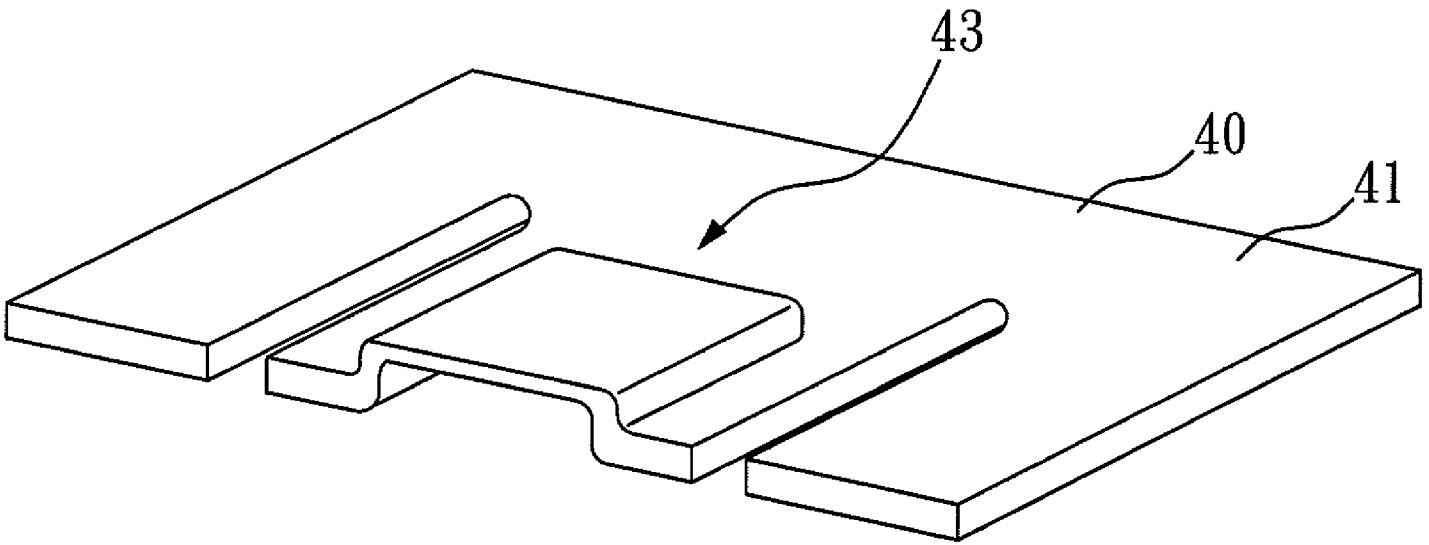
FIG. 5 shows a cross-sectional view of an electromagnetic actuator of the pattern-producing device of the present invention.
Figure 6:
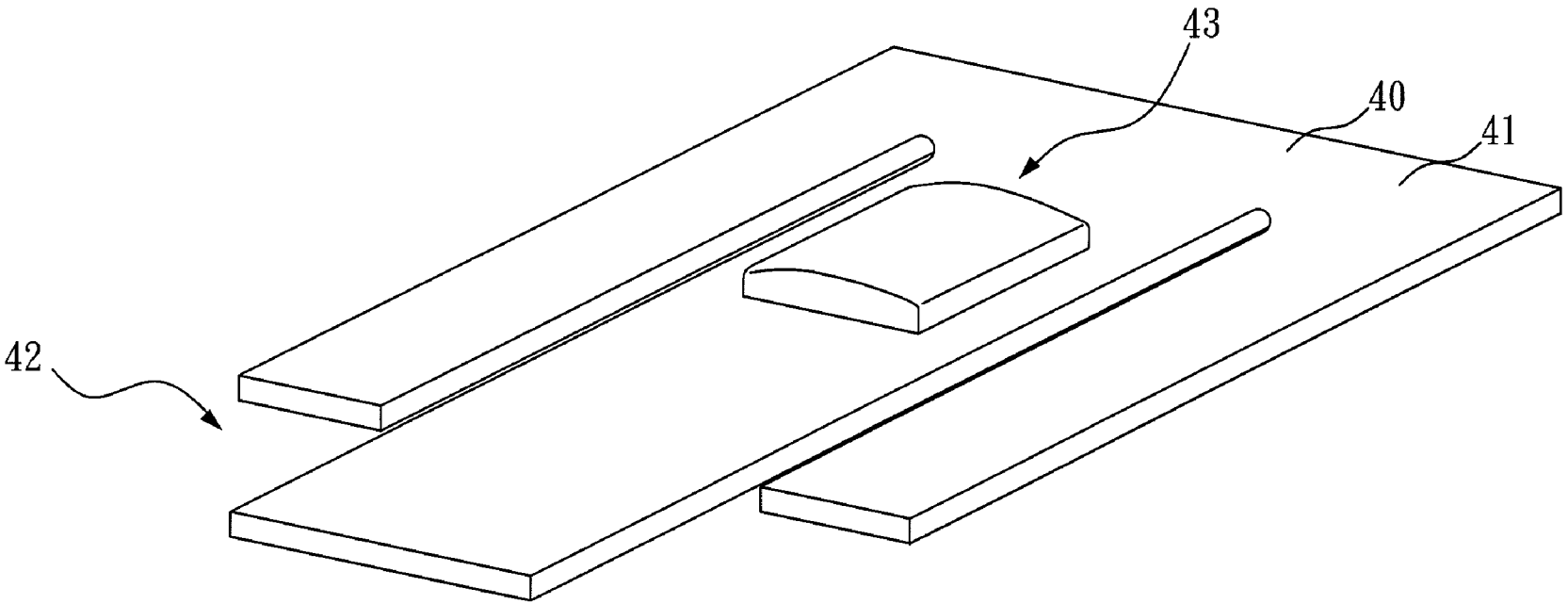
FIG. 6 shows an electromagnetic actuator of the pattern-producing device of the present invention.

As shown in FIG. 5, in one embodiment, the thickness of the convex part 43 is less than or equal to the thickness of the plate body 41, but the present invention is not restricted to this configuration. As shown in FIG. 2, in one embodiment, the convex part 43 has a flat surface, but again the present invention is not restricted to this configuration. For example, the convex part 43 can have a curved (as shown in FIG. 6) or an irregular surface to accommodate the formation needs of the work piece 20.

Although the present invention has been explained in relation to its preferred embodiments, it is also of vital importance to acknowledge that many other possible modifications and variations can be made without departing from the spirit and scope of the invention as hereinafter claimed.

What is claimed is:

1. A device for producing a pattern onto a work piece, comprising:

a die having a patterned surface with a pattern formed thereon;

an electromagnetic actuator having a plate body, a convex part and a strip unit, wherein the strip unit connects to the plate body and the convex part is structurally located on the strip unit or the plate body; and a base with the electromagnetic actuator disposed thereon;

when the electromagnetic actuator is supplied with a current pulse while the work piece is disposed between the patterned surface of the die and the electromagnetic actuator, a repulsive force is generated between the electromagnetic actuator and the work piece; and wherein the repulsive force causes the work piece to impact to the patterned surface, forcing the work piece to deform against the patterned surface and to take on the pattern.

2. The pattern-producing device as claimed in claim 1, wherein the convex part of the electromagnetic actuator is located on top of the strip unit, and wherein the convex part corresponds to a concave part of the work piece while the work piece is disposed between the patterned surface and the electromagnetic actuator.

3. The pattern-producing device as claimed in claim 1, wherein the plate body has a shape of a plate.

4. The pattern-producing device as claimed in claim 3, wherein a thickness of the convex part is less than or equal to a thickness of the plate body.

5. The pattern-producing device as claimed in claim 3, wherein the strip unit comprises three strips.

6. The pattern-producing device as claimed in claim 5, wherein the electromagnetic actuator is an E-shaped plate.

7. The pattern-producing device as claimed in claim 3, wherein the strip unit comprises a first strip, a second strip and a third strip, and wherein the convex part is located on top of the second strip.

8. The pattern-producing device as claimed in claim 7, wherein the electromagnetic actuator is an E-shaped plate.

9. The pattern-producing device as claimed in claim 1, wherein the convex part has a flat surface, a curved surface or an irregular surface.

10. The pattern-producing device as claimed in claim 1, wherein a dimension of the pattern ranges substantially between 0.5 μm to 10 mm.

11. The pattern-producing device as claimed in claim 1, wherein the base is made of an industrial plastic or a fiberglass resin.

12. The pattern-producing device as claimed in claim 3, wherein the strip unit comprises two strips.

13. The pattern-producing device as claimed in claim 12, wherein the electromagnetic actuator is a U-shaped plate.

14. The pattern-producing device as claimed in claim 3, wherein the strip unit comprises one strip.

15. The pattern-producing device as claimed in claim 14, wherein the electromagnetic actuator is a T-shaped plate.

16. The pattern-producing device as claimed in claim 1, wherein the convex part of the electromagnetic actuator is located on top of the plate body, and wherein the convex part corresponds to a concave part of the work piece while the work piece is disposed between the patterned surface and the electromagnetic actuator.

17. The pattern-producing device as claimed in claim 1, wherein the strip unit of the electromagnetic actuator is electrically connected to a power source.

* * * * *